US009605532B2

(12) United States Patent
Cayeux

(10) Patent No.: US 9,605,532 B2
(45) Date of Patent: Mar. 28, 2017

(54) METHOD AND DEVICE FOR DETERMINING A DRILL BIT'S POSITION IN A BOREHOLE

(75) Inventor: Eric Cayeux, Sandnes (NO)

(73) Assignee: International Research Institute of Stavanger AS, Stavanger (NO)

( * ) Notice: Subject to any disclaimer, the term of this patent is extended or adjusted under 35 U.S.C. 154(b) by 618 days.

(21) Appl. No.: 14/127,446

(22) PCT Filed: Jun. 27, 2012

(86) PCT No.: PCT/NO2012/050121

§ 371 (c)(1),
(2), (4) Date: Feb. 13, 2014

(87) PCT Pub. No.: WO2013/002645

PCT Pub. Date: Jan. 3, 2013

(65) Prior Publication Data

US 2014/0174826 A1 Jun. 26, 2014

(30) Foreign Application Priority Data

Jun. 28, 2011 (NO) ..... 20110932

(51) Int. Cl.

| | |
|---|---|
| ***E21B 47/09*** | (2012.01) |
| ***E21B 47/14*** | (2006.01) |
| ***E21B 47/04*** | (2012.01) |

(52) U.S. Cl.

CPC ..... *E21B 47/09* (2013.01); *E21B 47/04* (2013.01); *E21B 47/14* (2013.01)

(58) Field of Classification Search

CPC ..... E21B 47/09; E21B 47/04; E21B 47/14; E21B 47/01

See application file for complete search history.

(56) References Cited

U.S. PATENT DOCUMENTS

| | | | | |
|---|---|---|---|---|
| 4,110,688 | A | 8/1978 | Bailey | |
| 4,964,462 | A | 10/1990 | Smith | |
| 5,274,552 | A | 12/1993 | Milburn | |
| 2002/0121369 | A1 | 9/2002 | Allen | |
| 2008/0105427 | A1* | 5/2008 | Hampton | E21B 47/04 166/255.1 |
| 2009/0294174 | A1 | 12/2009 | Harmer et al. | |
| 2011/0226531 | A1* | 9/2011 | Jones | E21B 47/082 175/50 |

OTHER PUBLICATIONS

International Search Report for parent application PCT/NO2012/050121, having a mailing date of Sep. 25, 2012.

* cited by examiner

*Primary Examiner* — Wei Wang
(74) *Attorney, Agent, or Firm* — Andrus Intellectual Property Law, LLP

(57) ABSTRACT

A method is for determining the position of a lower portion of a drill string in a bore hole. The drill string comprises a number of drill string components, each drill string component being interconnected by means of at least one joint. Several ultrasonic sensors are arranged after each other along a drill string. The method comprises localizing the position of the chamfer of the joint relative to the ultrasonic sensors.

7 Claims, 2 Drawing Sheets

METHOD AND DEVICE FOR DETERMINING A DRILL BIT'S POSITION IN A BOREHOLE

CROSS-REFERENCE TO RELATED APPLICATIONS

Figure 1:
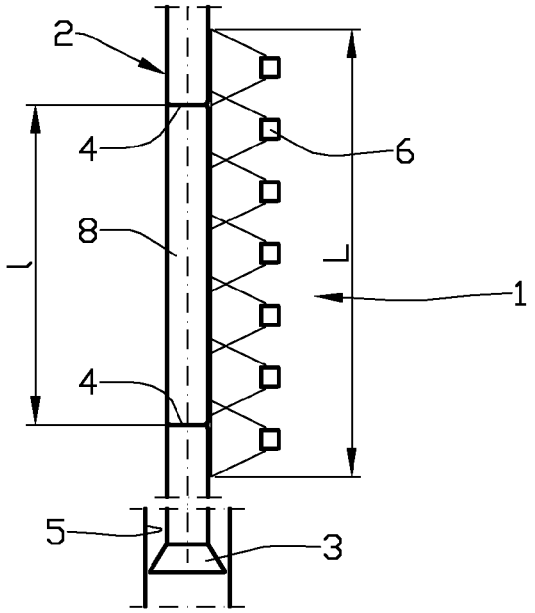

This application is the U.S. national stage application of International Application No. PCT/NO2012/050121, filed Jun. 27, 2012, which International application was published on Jan. 3, 2013 as International Publication No. WO 2013/002645 A1 in the English language and which application is incorporated herein by reference. The International application claims priority of Norwegian Patent Application No. 20110932, filed Jun. 28, 2011, which application is incorporated herein by reference.

The invention relates to a method for determining the position of the lower portion of a drill string in a bore hole. More particularly it relates to a method for determining the position of the lower portion of a drill string in a bore hole wherein the drill string comprises a number of drill string components, wherein each drill string component is interconnected by means of at least one joint, and wherein a number of ultrasonic sensors are arranged after each other along a drill string. The invention also comprises a device for carrying out the invention.

During works in a well, typically in a petroleum well, it is very important to know the position, i.e. depth in the borehole, the lower portion of the drill string is located in. This is particularly important when for example casing shall be set at a particular depth or when laterals shall be established in the well or retrieved.

Traditionally there is kept a log over all drill string components wherein the length of each individual drill string component is specified. The length of the drill string, and thereby the position of the lower portion of the drill pipe, may be determined by summing up the length of all drill string components included in the drill string.

However, it turns out that such calculations may be inaccurate, inter alia because other drill string components than the originally planned are used, and because the length of some drill string components are changed, e.g. due to repair work. In practical situations this has resulted in that sometimes drill string components are left out in order to ensure that the drill string is not too long.

Several automatic systems for recording and logging of drill string components are known. E.g. each component may be electronically identified while it is moved into or out of the bore hole. When the length of each individual drill string component is known, the length of the drill string may be determined.

U.S. Pat. No. 5,274,552 depicts a device where an ultrasonic movement sensor monitors the drill string. When movement of the drill string is detected, the movement of the main block is measured, which can be used to determine the position of the drill bit in the bore hole.

Other methods utilize weight differences measured in the main block to determine whether drill string components are supplied to or removed from the drill string.

These automatic recording systems have, due to insufficient reliability, gained relatively little use.

The invention has for its object to remedy or reduce at lea one of the drawbacks of the prior art.

According to the invention the object is achieved through features which are specified in the description below and in the accompanying claims.

There is provided a method for determining the position of the lower portion of a drill string in a bore hole, and wherein the drill string comprises a number of drill string components, each drill string component being interconnected by means of at least one joint, and wherein several ultrasonic sensors are arranged after each other along a drill string, and wherein the method is characterized in comprising localizing the position of the chamfer of the joint relative to the ultrasonic sensors.

The method may further comprise:

- arranging several ultrasonic sensors in a length along the drill string over a length which is larger than maximum expected distance between neighbouring joints of drill string components;
- continuously or in short intervals determine the position of the chamfer relative to the ultrasonic sensors;
- following the chamfer in a joint at least until the chamfer in a neighbouring joint comes within the measuring range of a sensor;
- recording the position of the chamfer of the joint in a period wherein the joint is selected as primary joint;
- determining the position of the lower portion of the drill string in the bore hole by summing up the moved distance travelled by joints while they are primary joints.

Ultrasonic sensors and pertaining algorithms are well-known to a man skilled in the art, and are here not further described.

Measurements of this kind must be carried out through drilling liquid, which when the drilling liquid flows back from the bore hole, often contain cuttings.

If more than one tubing joint is located within the measurement range of the ultrasonic sensors, one of the joints is selected to be a primary joint. By determining the position of the chamfer of a joint continuously or in short intervals, the position of the joint is determined relatively accurate even if a measurement should fail, e.g. caused by too much cuttings between an ultrasonic sensor and the joint.

It is also possible to switch between the joints in such a way that the joint located in the measuring range and which gives the best measuring signal, is selected as primary joint in a period.

The summing up determines how large length of the drill string that has passed the ultrasonic sensors.

A chamfer may be formed, e.g. of a bevel or a rounded edge.

The method may further comprise determining the position of the lower portion of a drill string by determining the position of the primary joint relative to the bore hole. In this way the position of the lower portion of the drill string relative to a datum point may be determined.

The method may be carried out by means of measuring equipment in order to determine the position of the lower portion of a drill string in a bore hole, wherein a drill string comprises a number of drill string components, each drill string component being interconnected by at least one joint, and a number of ultrasonic sensors are arranged after each other along a drill string, the sensors being arranged in a length along the drill string which is larger than maximum expected distance between neighbouring joints of drill string components.

The measuring range of the ultrasonic sensors may overlap in order to achieve a "seamless" transition when the joint is located between the measuring range of two ultrasonic sensors.

The ultrasonic sensors may be arranged in an annulus between the drill string and an outer tubular, e.g. a riser.

They can be arranged in a frame which complementary fits into the annulus, the frame may be suspended from the drill floor.

A method and device according to the invention enables reading of the position of a drill string with relative large accuracy. The proposed methodology make the method relatively little sensitive for incorrect readings, which is important in a rather demanding environment.

It is obvious that the method and device can also be used to determine the position of other components connected to the drill string in the bore hole.

Figure 2:
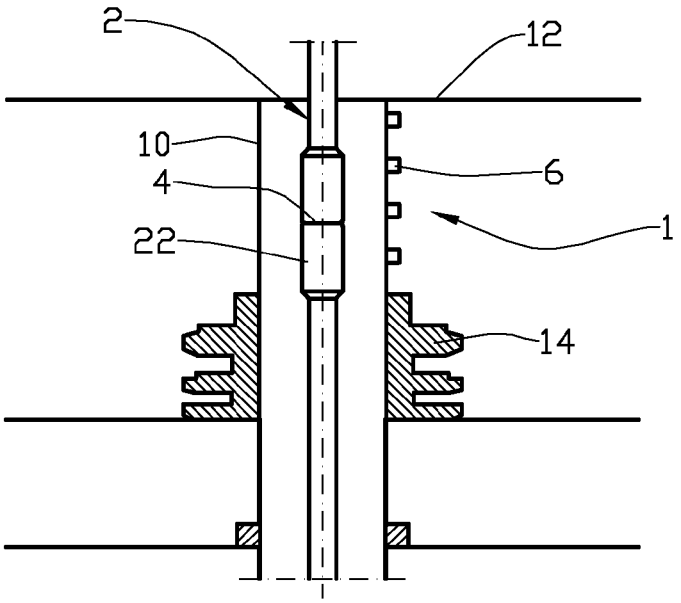
Figure 3:
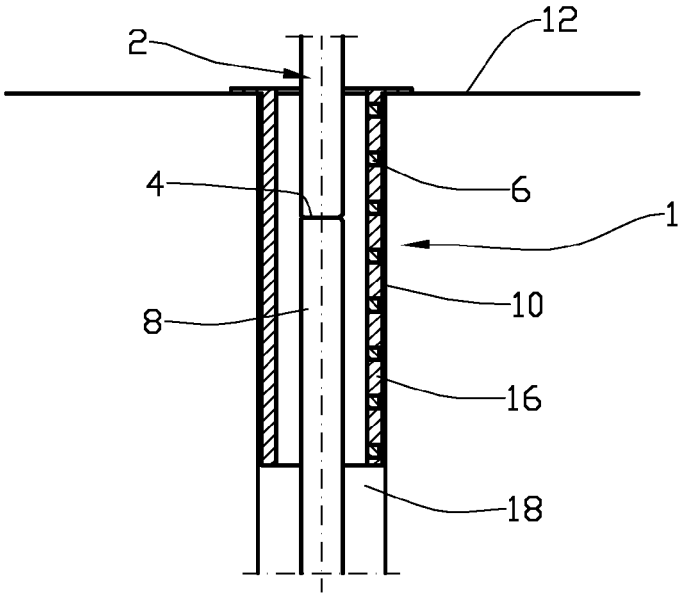
Figure 4:
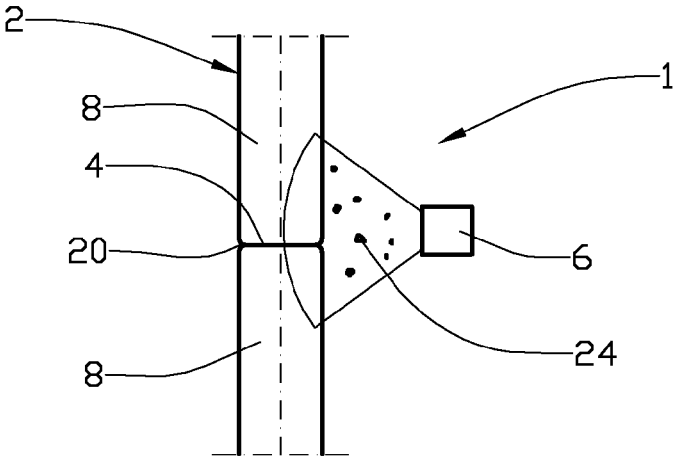

In what follows, an example of a preferred method and embodiment is described, which is visualized in the accompanying drawings, in which:

FIG. 1 schematically illustrates a section of a drill string located at ultrasonic sensors according to the invention;

FIG. 2 schematically illustrates a possible positioning of the ultrasonic sensors on a fixed drilling platform;

FIG. 3 schematically illustrates a practical installation of the ultrasonic sensors; and FIG. 4 schematically and in a larger scale illustrates a section of a drill string and an ultrasonic sensor.

In the drawings reference numeral 1 designates a measuring equipment for position-measuring of a pipe joint 4 of a drill string 2 and thereby the position of the lower portion 3 of a drill string, the drill string 2 extending down to the lower portion 3 of the drill string in a well 5. A number of ultrasonic sensors 6 have a total measuring range "L" which is larger than a maximum expected distance "I" between neighbouring pipe joints 4 of drill string components 8 of a drill string 2.

The ultrasonic sensors 6 are in FIG. 2 allocated to a riser 10 located between a drill floor 12 and a blowout preventer 14.

Due to the relatively modest range of the ultrasonic sensors 6, the ultrasonic sensors 6 are arranged in a frame 16 located in an annulus 18 between the drill string 2 and the riser 10, see FIG. 3, wherein the frame 16 is suspended from the drill floor 12.

According to the invention the ultrasonic sensors 6 are arranged for localizing a chamfer 20 in the joint 4 between two drill string components 8. Such a chamfer 20 is always present in the joint 4 of a drill string 2 whether or not the joint 4 comprises a box portion 22 as illustrated in FIG. 2. In FIG. 4 it is also indicated how cuttings 24 may be located between the ultrasonic sensor 6 and the chamfer 20, which may disturb the localizing of the chamfer 20.

By performing measurements and calculations as explained in the general part of the description, the position of a chamfer 20 and the distance from this to the neighbouring joint may be reliably determined, and thereby a calculation of the position of the lower portion 3 of a drill string 2 in the bore hole 5 can be performed.

The invention claimed is:

1. A method for determining the position of a lower portion of a drill string in a bore hole, the drill string comprising a number of drill string components, each drill string component being interconnected by means of at least one joint, and wherein several ultrasonic sensors are arranged after each other along the drill string, and wherein the method comprises localizing the position of a chamfer of the joint relative to the ultrasonic sensors, wherein the method further comprises:

arranging the ultrasonic sensors over a length along the drill string, the length being larger than a maximum distance between neighbouring joints of the drill string components;

continuously or in short intervals determining the position of the chamfer of the joint along the ultrasonic sensors;

following the chamfer in the joint at least until the chamfer in a neighbouring joint comes within a measuring range of one of the ultrasonic sensors;

recording the position of the chamfer of the joint in a period wherein the joint is selected as a primary joint; and determining the position of a lower portion of the drill string in the bore hole by summing up a measured moved distance travelled by the joints while the joints are primary joints.

2. The method of claim 1, wherein the method further comprises determining the position of the lower portion of the drill string by determining the position of the primary joints relative to the bore hole.

3. A measuring device for determining the position of a lower portion of a drill string in a bore hole, the device comprising a number of ultrasonic sensors arranged after each other along the drill string, wherein the ultrasonic sensors have measuring ranges directed toward the drill string and are arranged in a length along the drill string which is larger than a maximum distance between neighboring joints of drill string components, and wherein the ultrasonic sensors are located separate from the drill string and stationary in the bore hole adjacent a path of the drill string.

4. The device of claim 3, wherein the measuring ranges of the ultrasonic sensors overlap.

5. The device of claim 3, wherein the ultrasonic sensors are arranged in an annulus between the drill string and an outer tubular.

6. The device of claim 5, wherein the ultrasonic sensors are arranged in a frame which complementary fits into the annulus.

7. The device of claim 6, wherein the frame is suspended from a drill floor.

* * * * *